US007241033B2

(12) United States Patent
Opolka

(10) Patent No.: US 7,241,033 B2
(45) Date of Patent: Jul. 10, 2007

(54) REFLECTOR LAMP

(75) Inventor: Rainer Opolka, Solingen (DE)

(73) Assignee: Zweibruder Optoelectronics GmbH, Solingen (DE)

( * ) Notice: Subject to any disclaimer, the term of this patent is extended or adjusted under 35 U.S.C. 154(b) by 92 days.

(21) Appl. No.: 11/113,355

(22) Filed: Apr. 22, 2005

(65) Prior Publication Data

US 2005/0237750 A1 Oct. 27, 2005

(30) Foreign Application Priority Data

Apr. 23, 2004 (DE) ..... 20 2004 006 432 U

(51) Int. Cl.
*F21S 8/08* (2006.01)

(52) U.S. Cl. ..... 362/419; 362/285; 362/298; 362/350; 362/442; 362/659

(58) Field of Classification Search ..... 362/277, 362/285, 296, 298, 341, 347, 350, 418, 429, 362/442, 652, 657–659, 419
See application file for complete search history.

(56) References Cited

U.S. PATENT DOCUMENTS 4,395,750 A * 7/1983 Scheidemann et al. ..... 362/239
4,400,765 A * 8/1983 Kochem ..... 362/277

* cited by examiner

*Primary Examiner*—Sandra O'Shea
*Assistant Examiner*—Jason Moon Han
(74) *Attorney, Agent, or Firm*—Andrew Wilford

(57) ABSTRACT

A reflective lamp in which the light source is connected to the reflector through a stirrup and in which either or both the reflector and the light source can be axially adjusted but the light source lies externally of the reflector shell.

12 Claims, 3 Drawing Sheets

REFLECTOR LAMP

BACKGROUND OF THE INVENTION

Field of the Invention

My present invention relates to reflector lamp having a reflector and a light source which is adjustable relative to the reflector along the reflector axis.

A reflector lamp having a reflector and a light source which are movable relative to one another has been described in Swiss Patent CH 14 69 87 A. The incandescent lamp is axially shiftable in the neck of a reflector housing, and a mount for the incandescent lamp is displaceable along a reflector axis. The connection between the lamp mount and the neck of the reflector is formed by a pin guided in a curved track. By the swing of a lever connected to the lamp mount, the lamp mount is rotated about the axis and is axially displaced as its pin is guided in the track to thereby focus the lamp.

In another Swiss Patent CH 22 11 09A, a reflector lamp is provided with a device for changing focus. By contrast with the previously described arrangement, the position of the reflector is altered rather than the position of the incandescent lamp. A cap carrying the reflector is rotatable on a housing part to which the lamp mount is connected, and by rotation of the cap the reflector is displaced relative to the incandescent lamp along the axis.

OBJECTS OF THE INVENTION

It is the principal object of the present invention to provide a reflector lamp which allows focusing adjustment of the relative positions of the light source and the reflector but wherein the lamp is more versatile or flexible as to its applications.

Another object of the invention is to provide structural advantages over earlier lamp systems in which a lighted source is positioned adjustably relative to a reflector.

SUMMARY OF THE INVENTION

These objects are attained, in accordance with the invention with a reflector lamp comprising:

a reflector having a reflector shell and a reflective surface surrounding an axis;

a stirrup connected to the reflector shell at one end and having another end reaching toward the axis outside the reflector shell; and a light source on the other end of the stirrup outside the shell and displaceable relative to the reflective surface along the axis.

The other end of the stirrup is formed with a ring-shaped holder, the light source being provided in a rod-shaped body axially shiftable in the holder.

A screw connection can be provided between the holder and the body enabling axial displacement of the body relative to the reflective surface.

Thus according to the invention the light source is located outside of the reflector shell and is connected with the reflector by at least one stirrup, i.e. a bent member or a bend having a continuous arc between its opposite ends. Preferably the light source is provided in an elongated or rod-shaped body which is axially shiftable in a holding ring provided at the free end of the stirrup or bent arc. The light source itself is preferably a light emitting diode or a number of light emitting diodes.

When a screw thread arrangement is provided between the body and the holding ring, a stepless adjustment of the position of the light-emitting diode in the rod-shaped body and the reflector is possible along the axis. However, other types of connections between the body and the reflector which permit such movement are also possible. For example if the ring simply is frictionally slidable in a ring relative to the body, a positioning of the body relative to the reflector is also possible. The screw connection however has the advantages of controlled displacement of the body in the ring. A more exact positioning of the light source by a clamping arrangement in the ring is possible. Between the ring and the body an indexing arrangement is likewise possible to provide stepped adjustment of the body in the ring.

In a further feature of the invention, the retaining ring itself is rotatable and/or pivotable about a hinge joint or the like on the free end of the stirrup arm so that apart from the axial positioning of the light-emitting diode it is also possible to vary the orientation of the axis of the light-emitting diode with respect to the reflector axis.

Preferably the reflector is a hollow mirror that can have its outer shell a base from which two pin contacts which can intersect and be inserted into a conventional contact socket to supply the lamp with electric current. The current conductors within the lamp can run through the stirrup to connect the light source with the reflector base. The reflector itself can be axially shiftable in a ring forming a holder for the reflector and the arrangement for displacement of the reflector can include a screwthread at the mouth of the reflector or at the socket for axial adjusting of the reflector.

To avoid light scattering in a preferred embodiment of the invention, a collecting lens is advantageously provided ahead of the light source.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
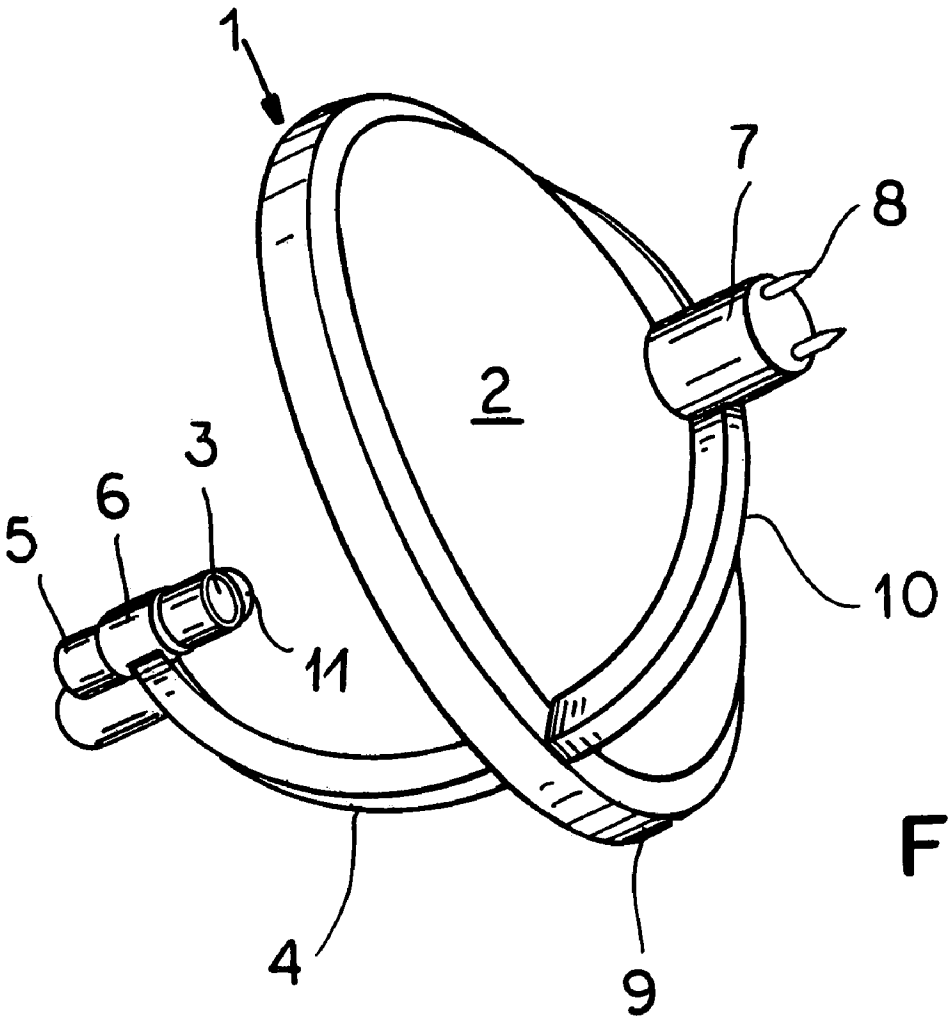
FIG. 1 is a perspective view of the reflector lamp of the invention in somewhat diagrammatic form.
Figure 2:
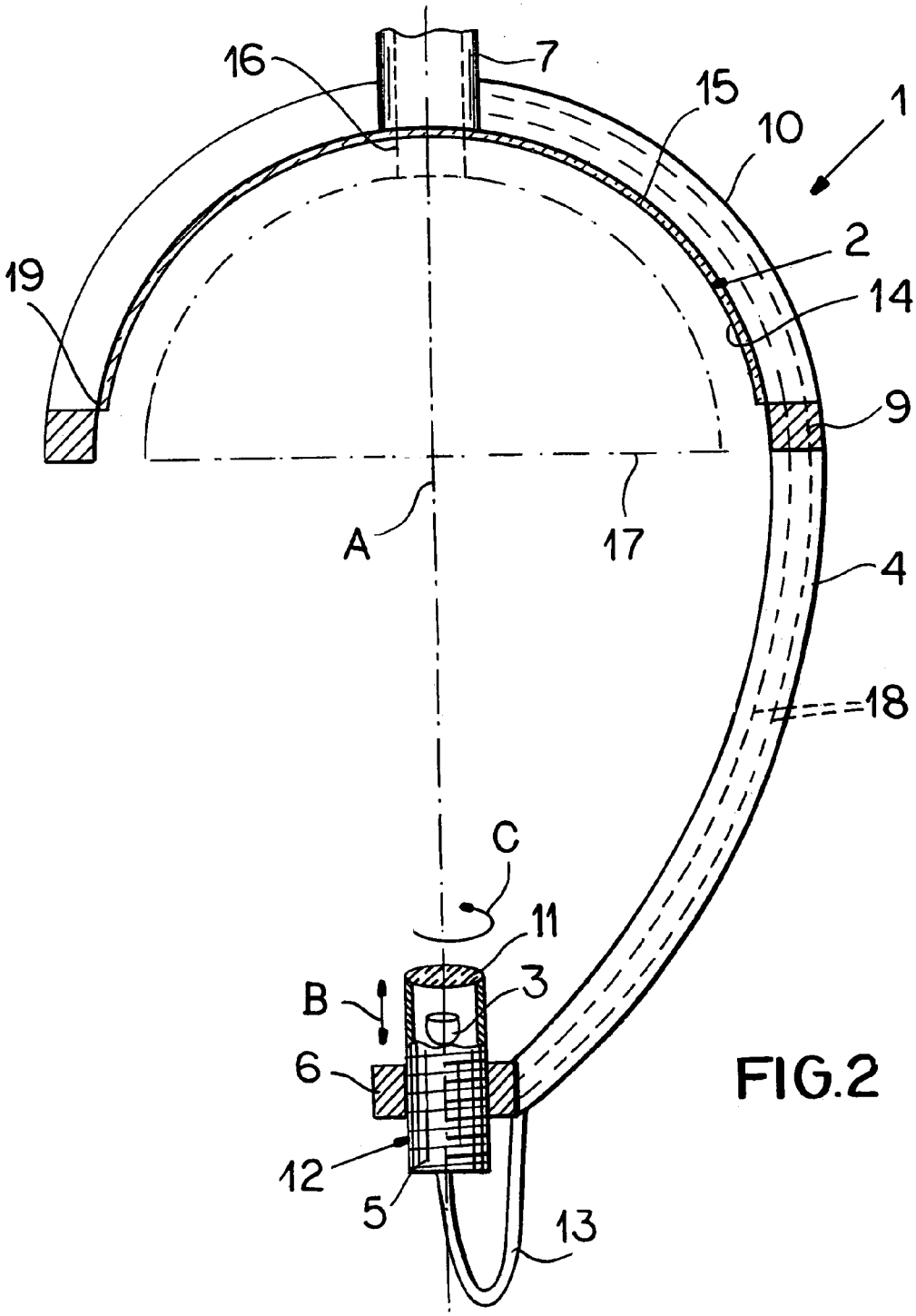
FIG. 2 is a cross sectional view through the lamp.

The illustrated reflector lamp 1 (FIGS. 1 and 2) comprises a reflector 2 and a light source 3 which is located outside of a shell 15 of the reflector 2 and is connected by a stirrup 4 with the reflector 2. The light source 3, here a light-emitting diode (see especially FIG. 2) is protected within a rod-shaped body 5. The rod-shaped body 5 is formed at least over part of its periphery with a male screwthread and is threaded into a retaining ring 6 formed on the free end of the stirrup 4, the ring 6 having an internal screwthread for that purpose. The screwthread arrangement constitutes means 12 for axially adjusting the body 5 and the light source 3 relative to a reflective surface 14 of the mirrored reflector 2. An axis of the reflector is shown at A and the displaceability of the body 5 in the axial direction is represented by the double headed arrow B. Another arrow C represents the rotation of the body 5. By rotation of the rod-shaped body 5 in the thread of the holding ring 6, the axial position of the light source 3 relative to the reflector 2 can be changed until the desired focus is obtained.

The reflector 2 can have a threaded sleeve 16 which threadedly engages a base 7 to allow adjustment of the reflector 2 as has been diagrammatically shown by a dot-dash position thereof, slightly reduced in size at 17 simply to allow an alternative axial position of the reflector to be clearly visible in the drawing. Alternatively, a ring 9 and an end 19 of the reflector 2 around its opening can be threaded to enable axial displacement of the reflector relative to the stirrup 4.

The base 7, which is located centrally on the outer shell 15 of the reflector 2 can have two pins 8 projecting therefrom to allow the reflector lamp 1 to be plugged into an electrical socket and supplied with electric current.

The reflector lamp has an extended segment 10 of the stirrup 4 secured to the ring 9 and carrying the base 7. The electric conductors which run to the light source 3 from the pins 8 can pass through the stirrup 4 as shown at 18 and a loop of the conductors can run to the body 5 as shown at 13. A collecting lens 11 can be provided ahead of the light source 3 to eliminate stray light. Other light sources than a light-emitting diode can be used in accordance with the invention and the contacts and conductors can be configured accordingly.

Figure 4:
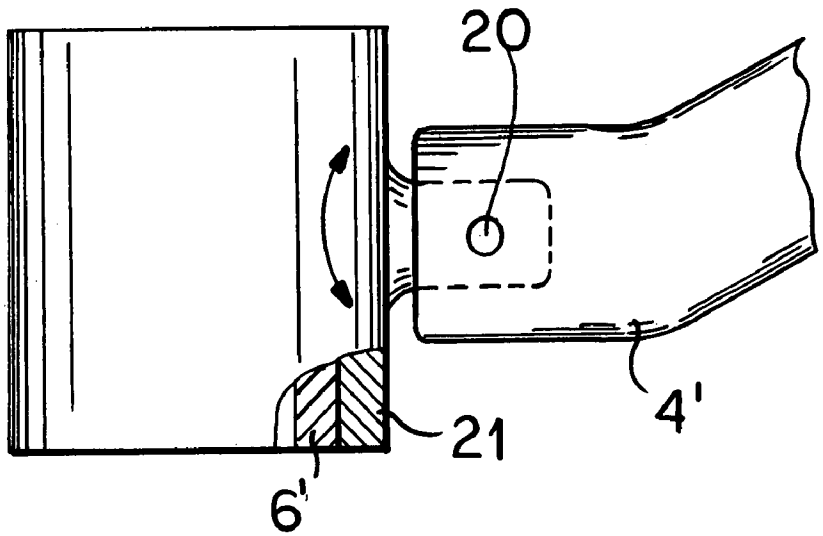
FIG. 4 is a partly sectional side view of that pivot arrangement.
Figure 3:
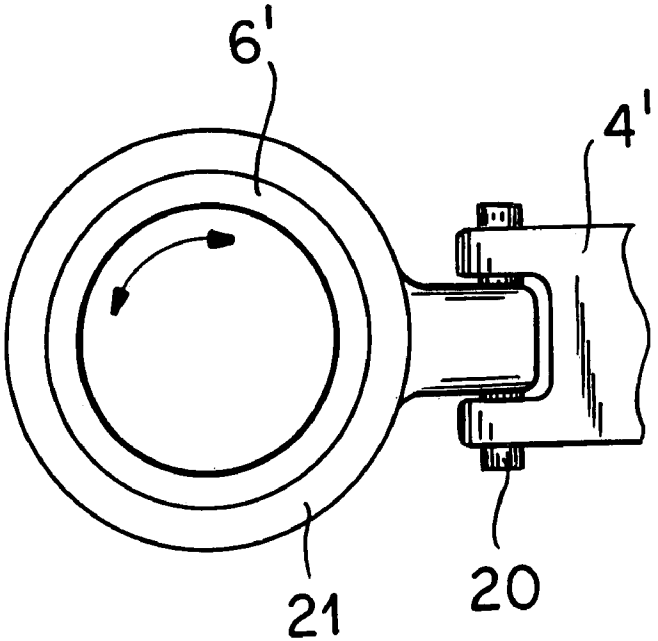
FIG. 3 is a detail view showing a pivot arrangement for the holding ring.

FIGS. 3 and 4 show that the ring 6' can be connected to the end of the stirrup 4' by a hinge joint 20, if desired, and further that the ring 6' can be rotatable, if desired, about an axis 21 to allow tilting of the assembly of the ring 6' and the body 5 for orientation of the axis of the light source about the axes of the pivots 20 and 21.

I claim:

1. A reflector lamp comprising:

a reflector having a reflector shell and a reflective surface surrounding an axis;

a stirrup connected to said reflector shell at one end and having another end reaching toward said axis outside said reflector shell and formed with a ring-shaped holder; and a rod-shaped light source provided in the holder on said other end of said stirrup outside said shell and axially displaceable in the holder relative to said reflective surface along said axis.

2. The reflector lamp defined in claim 1, further comprising a screw connection between said holder and said body enabling axial displacement of said body relative to said reflective surface.

3. The reflector lamp defined in claim 1 wherein said holder is connected to said other end of said stirrup by a hinge.

4. The reflector lamp defined in claim 1 wherein said holder is connected to said other end of said stirrup by a pivot.

5. The reflector lamp defined in claim 1 wherein said light source includes at least one light-emitting diode.

6. The reflector lamp defined in claim 1 wherein said reflector is a hollow mirror.

7. A reflector lamp comprising:

a reflector having a reflective surface surrounding an axis and a reflector shell having a base;

a stirrup connected to the reflector shell at one end and having another end reaching toward the axis outside the reflector shell;

a light source on the other end of the stirrup outside the shell and displaceable relative to the reflective surface along the axis; and pin contacts provided on the base of the shell for connecting the lamp to a power source.

8. The reflector lamp defined in claim 7 wherein said stirrup spans across said shell and is formed with said base.

9. The reflector lamp defined in claim 8 wherein conductors from said pin contacts of said base run through said stirrup.

10. The reflector lamp defined in claim 7 wherein said reflector is mounted at an opening of the base or at said base in a further ring holder for movement along said axis.

11. The reflector lamp defined in claim 10 wherein said reflector is mounted at an opening of the base or at said base in a further ring holder for movement along said axis by a screw thread connection.

12. The reflector lamp defined in claim 1, further comprising a collecting lens between said source and said surface.

* * * * *